United States Patent [19]

Inui

[11] Patent Number: 4,492,727

[45] Date of Patent: Jan. 8, 1985

[54] INK DONOR SHEET

[75] Inventor: Toshiharu Inui, Kanagawa, Japan

[73] Assignee: Fuji Xerox Company, Ltd., Tokyo, Japan

[21] Appl. No.: 438,186

[22] Filed: Nov. 1, 1982

[30] Foreign Application Priority Data

Oct. 30, 1981 [JP] Japan ..... 56-172894

[51] Int. Cl.[3] ..... B41M 5/26

[52] U.S. Cl. ..... 428/216; 428/211; 428/447; 428/452; 428/537.5; 428/913; 428/914

[58] Field of Search ..... 428/195, 200, 204, 211, 428/320.2, 452, 488, 537, 913, 914, 207, 212, 213, 215, 216, 447

[56] References Cited

U.S. PATENT DOCUMENTS 4,235,657 11/1980 Greenman et al. ..... 428/914
4,321,286 3/1982 Scott et al. ..... 428/914
4,387,132 6/1983 Hain ..... 428/914

*Primary Examiner*—Bruce H. Hess
*Attorney, Agent, or Firm*—Sughrue, Mion, Zinn, Macpeak and Seas

[57] ABSTRACT

An ink donor sheet recording medium is disclosed. The medium is comprised of a paper base which has a solidified ink layer formed on one surface. The paper base is rendered moisture proof by providing a dampproof layer on the surface opposite the ink layer or by incorporating a hydrophobic compound within the paper. By rendering the medium moisture proof the medium can be used under adverse humidity conditions without being physically distorted. Accordingly, the medium can form clear sharp images even when used in adverse humidity conditions.

6 Claims, 3 Drawing Figures

INK DONOR SHEET

FIELD OF THE INVENTION

The present invention relates to an ink donor sheet used as a recording medium for a transfer type heat-sensitive recording apparatus.

BACKGROUND OF THE INVENTION

In a heat-transfer recording apparatus, recording of image information is carried out by putting a heat recording medium (hereinafter, referred to as ink donor sheet) on a recording paper.

FIG. 1 shows a sectional structure of a conventional ink donor sheet. In the ink donor sheet 10, a heat-transfer (heat liquifying or heat-subliming) ink layer 12 is formed on a side of a thin paper base 11 having a thinkness of about 50 μm so as to have a thickness of about 10 μm. When a recording paper is brought into contact with the ink layer 12 and a heat pulse is applied from the side of the paper base 11, the ink on the heated part of the ink layer 12 liquifies or sublimes and is transferred to the recording paper, by which the image information is recorded.

A certain degree of heat resistance is required for the paper base of the ink donor sheet. Further, it is important to avoid interior transfer caused by sticking when the donor sheet is brought into contact with a thermal head for applying a heat pulse. For such a reason, condenser paper has been principally used until now as the paper base. However, papers composed chiefly of vegetable fibers such as condenser paper, etc. are easily influenced by moisture, which can cause expansion and contraction. As the result, for example, in an apparatus wherein heat-transfer recording is carried out by supplying a long ink donor sheet from a supplying roll to a thermal head of the recording part, waves are sometimes formed on the surface of the thin sheet, if the ink donor sheet is moistened at it moves toward the supplying passage. If ink donor sheet on which waves are formed becomes creased on the recording part it will cause the occurrence of inferior transfer.

SUMMARY OF THE INVENTION

The present invention was developed in light of the above described circumstances. A primary object of the present invention is to provide an ink donor sheet the paper base of which does not undergo expansion and contraction by the influence of moisture.

According to the present invention, the above described object is attained by forming a dampproof layer which prevents penetration of moisture on the side of the paper base where the ink layer is not formed, or by impregnating fibers of the paper base with a hydrophobic compound to render the paper base hydrophobic.

DETAILED DESCRIPTION OF THE INVENTION

In the following, the present invention is illustrated in detail with preferred embodiments. However, the scope of the invention is not limited to these embodiments.

Figure 1:
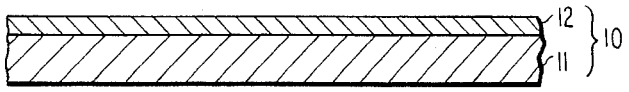
FIG. 1 is a cross-sectional view of a conventional ink donor sheet.
Figure 2:
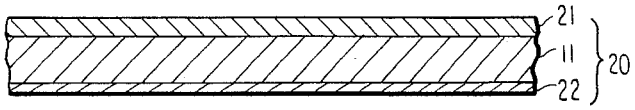
FIG. 2 is a cross-sectional view of a first embodiment of the ink donor sheet of the present invention.

FIG. 2 shows the sectional structure of a first embodiment of the ink donor sheet of the present invention. The ink donor sheet 20 is prepared by forming a heat-transfer ink layer 21 on a side of a paper base 11 such as condenser paper and forming a dampproof layer 22 on the other side thereof.

The ink layer 21 remains solid at ordinary temperature (20°–30° C.) and when it is heated to a certain temperature (50°–120° C.), its viscosity is decreased to liquify or sublime. Any conventional ink layer can be used for the purpose. In general, the ink layer comprises a binder, a coloring agent and a softening agent. Examples of the binder include waxes such as carnauba wax, ester wax, paraffin wax and rice wax. For the coloring agent, any coloring agent can be used, and those having good weatherability are preferred. Examples of the softening agent include oils such as caster oil, polyvinyl acetate, polystyrene, a styrene-butadiene copolymer, cellulose ester, cellulose ether and acrylic resins. Other additives may be added to facilitate coating of the ink layer and improve storability of the ink donor sheet, such as ethylene vinyl acetate. The formulation of ink layer is suitably determined taking into consideration the properties such as melting point, thermal conductivity, heat capacity, specific heat, heat of fusion, density, tensile strength, melt viscosity, etc. A representative formulation of the ink layer and typical properties of the ink layer are shown in Tables 1 and 2 below.

TABLE 1

| | wt % |
|---|---|
| Pigment (coloring agent) | 20 |
| Carnauba wax (binder) | 20 |
| Ester wax (binder) | 40 |
| Oil (softening agent) | 10 |
| Other (additive) | 10 |

TABLE 2

| Ink Layer No. | Melting Point (°C.) | Thermal Conductivity (Cal/cm sec °C.) | Heat Capacity (Cal/cm$^3$ °C.) | Specific Heat (Cal/g °C.) | Heat of Fusion (Cal/g) | Density (g/cm$^3$) | Tensile Strength (kg/cm$^3$) |
|---|---|---|---|---|---|---|---|
| 1 | 47 | $6.8 \times 10^{-4}$ | 0.68 | 0.73 | 44.1 | 0.93 | 8.4 |
| 2 | 52 | $7.2 \times 10^{-4}$ | 0.56 | 0.57 | 45.6 | 0.98 | 10.6 |
| 3 | 62 | $8.3 \times 10^{-4}$ | 0.57 | 0.58 | 51.9 | 0.98 | 15.2 |
| 4 | 67 | $6.2 \times 10^{-4}$ | 0.55 | 0.54 | 31.6 | 1.02 | 9.4 |
| 5 | 71 | $6.5 \times 10^{-4}$ | 0.57 | 0.58 | 29.5 | 0.99 | 4.5 |
| 6 | 73 | $8.8 \times 10^{-4}$ | 0.56 | 0.57 | 35.6 | 0.97 | 3.6 |

The ink layer is formed by a hot-melting method. The thickness of the ink layer is generally from 2 to 10 μm, preferably from 3 to 8 μm, more preferably from 4 to 6 μm.

The dampproof layer 22 is formed using a silicone resin having excellent heat resistance so as to have a thickness of 1 to 3 μm, preferably 1 to 1.5 μm.

Well known conventional techniques can be used for forming the dampproof layer 22 using a silicone resin. One known method involves using a coater such as an air doctor coater or a rod coater. According to this method, the resin adhering to the roll is transferred to the paper base which is conveyed by revolution of a roll, by which coating is carried out. Application of the resin to the paper base can be carried out by a spraying method which comprises spraying the resin with compressed air. The coated silicone resin is hardened by volatilizing the solvent or by heating the vapour, etc. to form the dampproof layer 22.

In the ink donor sheet 20 in which the dampproof layer 22 is formed, expansion and contraction by the influence of moisture can be prevented, because absorption of moisture by the paper base 11 is prevented by the ink layer 21 and the dampproof layer 22.

Figure 3:
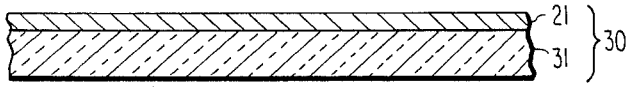
FIG. 3 is a cross-sectional view of a second embodiment of the ink donor sheet of the present invention.

FIG. 3 shows the sectional structure of a second embodiment of the ink donor sheet of the present invention. In the ink donor sheet 30, a heat-transfer ink layer 21 is formed on a dampproofing paper base 31 in the same manner as in the first embodiment. The dampproof paper base 31 is a paper base comprised of fiber impregnated with a hydrophobic compound to render the paper base hydrophobic. For example, vegetable fibers in the condenser paper are impregnated with a silicone oil having excellent heat resistance to produce a dampproof condenser paper 31. The dampproof condenser paper 31 can be formed by dipping condenser paper in a silicone oil bath or by spraying the silicone oil by means of a spray gun.

When the above described paper base is formed by being subjected to dampproofing, the fibers thereof are not swollen by moisture. Further, since the ink donor sheet does not require the formation of a dampproof layer the thickness of the sheet is not increased.

The paper base which can be used in the first and second embodiments has generally, a density of 0.8 to 1.45 g/cm$^3$, preferably 0.9 to 1.4 g/cm$^3$, more preferably 1.0 to 1.2 g/cm$^3$ and a thickness of 5 to 25 μm, preferably 7 to 18 μm, more preferably 8 to 13 μm.

Since the ink donor sheet of the present invention does not undergo expansion and contraction due to moisture, good recording images can be obtained even if the ink donor sheet is used in an apparatus placed under adverse moisture conditions or an apparatus which is seldom used.

In the above described embodiments, silicone resin and silicone oil are used for forming the dampproof layer or as an impregnating agent for dampproofing, but the present invention is not limited to these material. The term "dampproof" herein used means that absorption of moisture is prevented to an extent that interior transfer of ink does not occur on the recording paper when the ink donor sheet which is mounted on a heat-transfer recording machine and allowed to stand at 35° C. and 85% RH for 70 hours is subjected to heat-transfer recording. Further, the other methods of forming the dampproof layer can be utilized depending on the material to be used. Furthermore, the paper base of the ink donor sheet is not, of course, limited to condenser paper.

While the invention has been described in detail and with reference to specific embodiment thereof, it will be apparent to one skilled in the art that various changes and modifications can be made therein without departing from the spirit and scope thereof.

What is claimed is:

1. An ink donor sheet recording medium consisting essentially of a paper base;

an ink layer on a surface of the paper base, the ink layer comprising a solidified ink composition capable of being heat-transferred to a recording paper brought into contact with the ink layer upon heating through the paper base; and a dampproof layer comprising a silicone resin on the opposite surface of the paper base to prevent absorption of moisture in the paper base.

2. An ink donor sheet recording medium as claimed in claim 1, wherein the paper base has a density of 0.8 to 1.45 g/cm$^3$ and a thickness of 5 to 25 μm.

3. An ink donor sheet recording medium as claimed in claim 1, wherein the ink layer comprises a binder, a coloring agent and a softening agent.

4. An ink donor sheet recording medium as claimed in claim 1, wherein the ink layer has a thickness of 2 to 10 μm.

5. An ink donor sheet recording medium as claimed in claim 1, wherein the dampproof layer has a thickness of 1 to 3 μm.

6. An ink donor sheet recording medium as claimed in claim 1, wherein the paper base has a density of 0.8 to 1.45 g/cm$^2$ and a thickness of 5 to 25 μm; the ink layer has a thickness of 2 to 10 μm, and the dampproof layer has a thickness of 1 to 3 μm.

* * * * *